US007188633B2

(12) United States Patent
Zerillo

(10) Patent No.: US 7,188,633 B2
(45) Date of Patent: Mar. 13, 2007

(54) RETROFIT MOTOR AND CONTROL FOR PATIO UMBRELLAS

(76) Inventor: Michael Anthony Zerillo, 15821 E. Jericho Dr., Fountain Hills, AZ (US) 85268

( * ) Notice: Subject to any disclaimer, the term of this patent is extended or adjusted under 35 U.S.C. 154(b) by 207 days.

(21) Appl. No.: 10/737,330

(22) Filed: Dec. 17, 2003

(65) Prior Publication Data

US 2005/0133077 A1 Jun. 23, 2005

(51) Int. Cl.
*A45B 11/00* (2006.01)

(52) U.S. Cl. ..... 135/20.3; 135/98; 135/16

(58) Field of Classification Search ..... 135/20.3, 135/96, 98, 99, 16, 22, 908
See application file for complete search history.

(56) References Cited

U.S. PATENT DOCUMENTS 2,745,421 A * 5/1956 Russell ..... 135/38
2,951,492 A * 9/1960 Small ..... 135/20.3
2,960,094 A * 11/1960 Small ..... 135/22
5,178,174 A * 1/1993 Wu ..... 135/22
6,058,951 A * 5/2000 Wilson ..... 135/20.3
6,182,917 B1 * 2/2001 Lai ..... 242/390.8
6,543,464 B1 * 4/2003 Grady, II ..... 135/22
6,612,713 B1 * 9/2003 Kuelbs ..... 362/102
7,051,744 B2 * 5/2006 Hung ..... 135/20.3
2004/0040591 A1 * 3/2004 Ma ..... 135/908
2004/0055627 A1 * 3/2004 P. Moga ..... 135/16
2004/0149325 A1 * 8/2004 Kuelbs ..... 135/20.3
2005/0072451 A1 * 4/2005 Vivian et al. ..... 135/16
2005/0247332 A1 * 11/2005 Hung ..... 135/20.3

* cited by examiner

*Primary Examiner*—David R. Dunn
*Assistant Examiner*—Noah Chandler Hawk

(57) ABSTRACT

An electric opening and closing device that retrofits to new and existing patio and market umbrellas. Such umbrellas are commonly used to provide shade outdoors, and are usually installed through a hole in the center of a table or mounted freestanding in a support base. The invention consists of a low voltage reversible electric motor that attaches to the upper end of the umbrella mast, a cable reel driven by the motor, a length of cable with one end affixed to the cable reel and the opposite end affixed to the umbrella yoke, electric control switch, remote control means, and electric supply means.

1 Claim, 3 Drawing Sheets

RETROFIT MOTOR AND CONTROL FOR PATIO UMBRELLAS

CROSS-REFERENCE TO RELATED APPLICATIONS

U.S. Patent Documents

| | | | |
|---|---|---|---|
| 6612713 | September, 2003 | Kuelbs | 362/102 |
| 6543464 | April, 2003 | Grady | 135/22 |
| 6374840 | April, 2002 | Ma | 135/22 |
| 6182917 | February, 2001 | Lai | 242/390.8 |
| 6058951 | May, 2000 | Wilson | 135/20.3 |
| 4619281 | October, 1986 | Redl | 135/20.3 |
| 4011881 | March, 1997 | Becher | 135/20.3 |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Patio umbrellas and market umbrellas are frequently used to provide shade outdoors, and are also used for various applications indoors in homes, retail shopping centers, hotels, restaurants, and other locations. Patio umbrellas and market umbrellas are similar in form and function. In this text, patio umbrellas and market umbrellas are referred to as conventional patio umbrellas.

Conventional patio umbrellas are comprised of a mast that is generally 8 feet or more in height, a canopy having a diameter between 6 feet and 12 feet and made of fabric or other foldable material affixed at its center to the upper end of the mast, a plurality of ribs evenly spaced around the mast circumference, whereby one end of each rib is pivotally attached to the upper end of the mast under the canopy and the opposite end of each rib is attached to the canopy perimeter, and a plurality of levers whereby one end of each lever is pivotally attached to one of the ribs and the opposite end of each lever is pivotally attached to a yoke. The yoke forms a ring applied on the circumference of the mast and is movable along a portion of the length of the mast. Conventional patio umbrellas have a yoke operating means to cause the yoke to move up and down the mast to apply and reduce force on the levers and thereby the ribs causing the canopy to open and close. Yoke operating means of conventional patio umbrellas vary in configuration, however all require human effort to operate. An example of a yoke operating means is a mechanism comprising a hand operated winch, rope and pulley drivingly engaged with the yoke. Another example of a yoke operating means comprises one or more hand operated ropes over pulleys drivingly engaged with the yoke. Another example of a yoke operating means comprises manual hand lifting and lowering of the yoke, or other means requiring human effort to cause the yoke to move up and down the mast and thereby open and close the canopy.

When in use, the mast of a conventional patio umbrella stands in a vertical position with the canopy at the upper end and with its lower end installed through a hole in the center of a table and supported, or the mast can be supported by a structure in a freestanding position. In its closed position the canopy is folded compactly around the circumference of the mast. The canopy can be made to open when the yoke operating means forcibly moves the yoke toward the upper end of the mast thereby forcing the levers against the ribs causing the ribs to pivot upwards on mast attachment points and thereby lifting the canopy causing it to spread up and away from the mast to an open position. The canopy is retained in the open position by the yoke operating means or other retention means. In its open position the canopy can be made to close when the yoke operating means causes the yoke to move away from the upper end of the mast thereby reducing the lever force against the ribs and whereby gravity causes the ribs to pivot downward on mast attachment points and the canopy collapses and folds compactly around the circumference of the mast.

Various mechanisms have been invented to motorize patio umbrellas, however these involve modifications to the working parts of a conventional patio umbrella, or a completely new patio umbrella design. As described in the art, motorized patio umbrellas are only available as a factory equipped mechanism constructed by patio umbrella manufacturers. Patents disclosing such mechanisms include U.S. Pat. No. 6,612,713 to Kuelbs, U.S. Pat. No. 6,543,464 to Grady, U.S. Pat. No. 6,182,917 to Lai, and others.

Factory motorized patio umbrellas are growing in popularity because they offer luxury, convenience, and are easier to operate than conventional patio umbrellas. However, to enjoy these benefits requires the purchase of a new and expensive patio umbrella.

BRIEF SUMMARY OF THE INVENTION

A principal object of the present invention is to provide a low cost retrofit motor for opening and closing new and existing conventional patio umbrellas, and a control means including manual switch and remote control means.

An additional object of the present invention is to provide a retrofit motor and control means that an average person can easily install to a conventional patio umbrella with little or no modification to the umbrella.

DETAILED DESCRIPTION OF THE INVENTION

Figure 1:
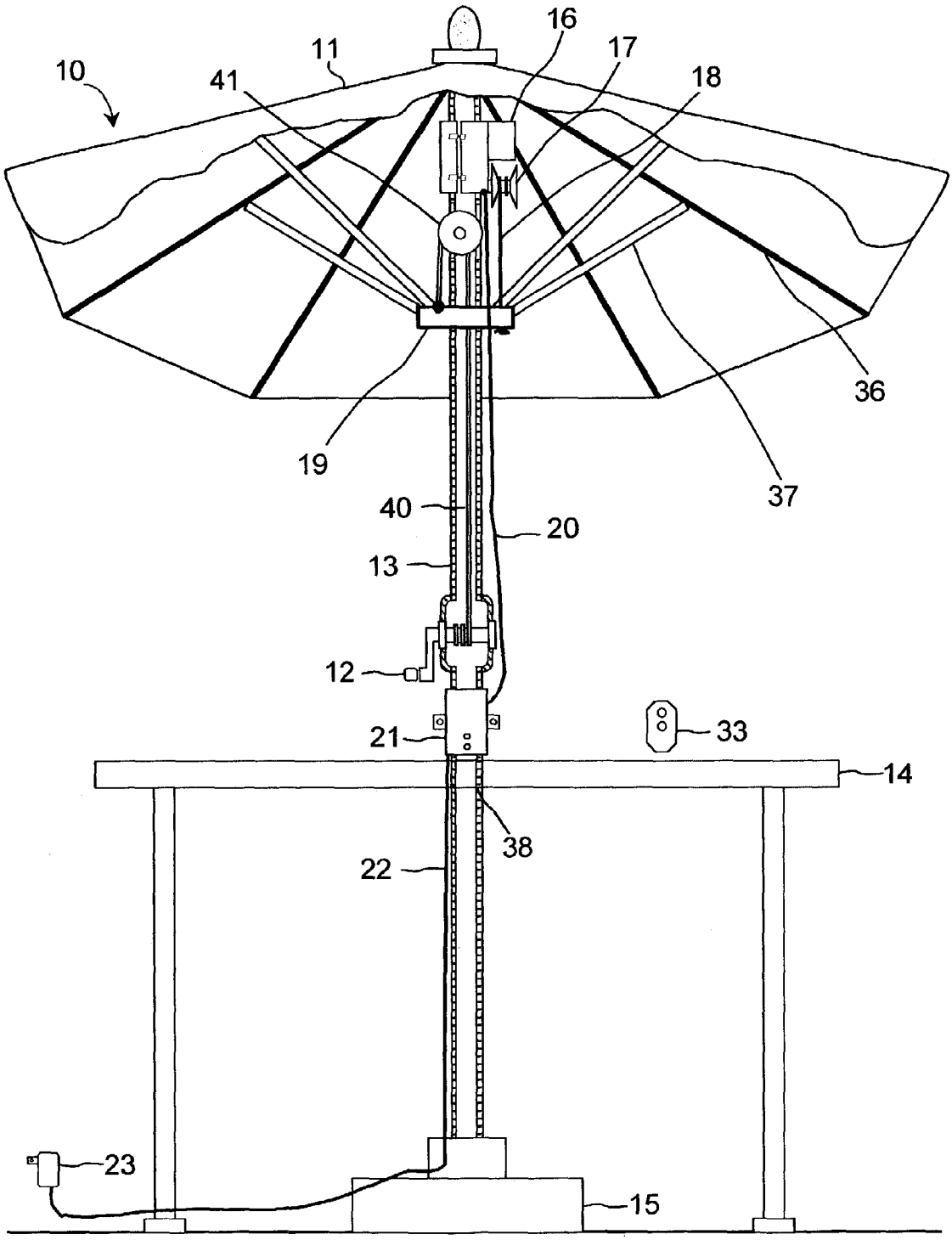
FIG. 1 illustrates a conventional patio umbrella with a cut-a-way view of its canopy in an open position. The umbrella opening and closing means is represented in a sectional view of the umbrella mast and includes a winch coupled with and driving a rope suspended over a pulley, whereby the rope is engaged with the umbrella yoke. The umbrella mast is installed through a hole in the center of a patio table and supported by a base. Also illustrated is a view of an embodiment of the present invention mounted to the umbrella mast under the canopy, a control module adjacent to the tabletop, electric wires, AC-DC Adapter and remote control transmitter.

FIG. 1 illustrates a view of a conventional patio umbrella 10 with mast 13 installed through hole 38 in center of patio table 14 and supported in base 15. Canopy 11 is illustrated in a cut-a-way open position. Canopy 11 is affixed at its center to mast 13 and supported by a plurality of ribs 36 each pivotally engaged at one end to mast 13 and affixed at each opposite end to canopy 11 perimeter. Also illustrated is a plurality of levers 37 pivotally engaged with ribs 36 and yoke 19. Yoke 19 forms a ring applied on the circumference of mast 13 and movable along a portion of the length of mast 13. Yoke 19 is driving engaged with winch mechanism 12. Winch mechanism 12 can be manually rotated to collect and dispense rope 40 over pulley 41 and thereby lift and lower yoke 19 causing levers 37 to pivot ribs 36 up and down and thereby open and close canopy 11.

Further illustrated in FIG. 1 is an embodiment of the present invention whereby motor housing 16 is affixed to the upper end of mast 13 under canopy 11, cable 18 is affixed to cable reel 17 at one end and at its opposite end affixed to yoke 19. Low voltage wire pair 20 connects motor housing 16 to control module 21 that is mounted to mast 13. Low voltage power cord 22 connects control module 21 to AC-DC electric power supply 23. Also illustrated is remote control transmitter 33.

Conventional patio umbrella 10 can have various means to open and close canopy 11 such as winch mechanism 12 in FIG. 1, or other means previously described in the background of the invention. The present invention provides a device that substitutes for the human effort that is required to drive the opening and closing means of conventional patio umbrella 10. The present invention can be retrofit to a new or existing conventional patio umbrella 10 with little or no modification to conventional patio umbrella 10. The present invention is designed for do-it-yourself installation and usually the only tool required is a screwdriver.

Figure 3:
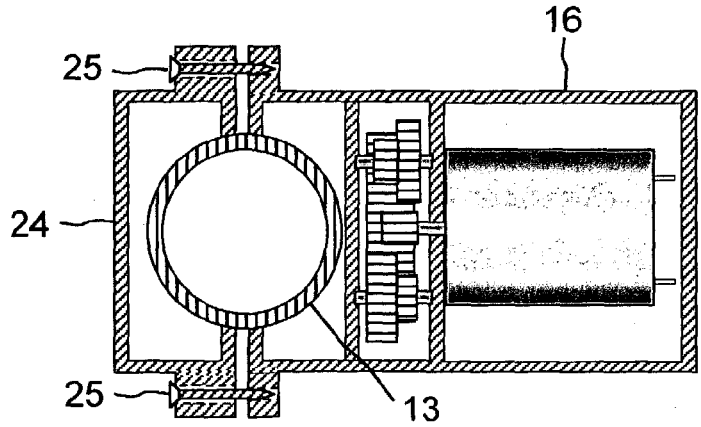
FIG. 3 illustrates a top down sectional view of a conventional patio umbrella mast and a partial embodiment of the present invention affixed to the mast and comprising a motor housing, a low voltage reversible motor driving gears, motor housing mounting bracket and assembly screws.
Figure 4:
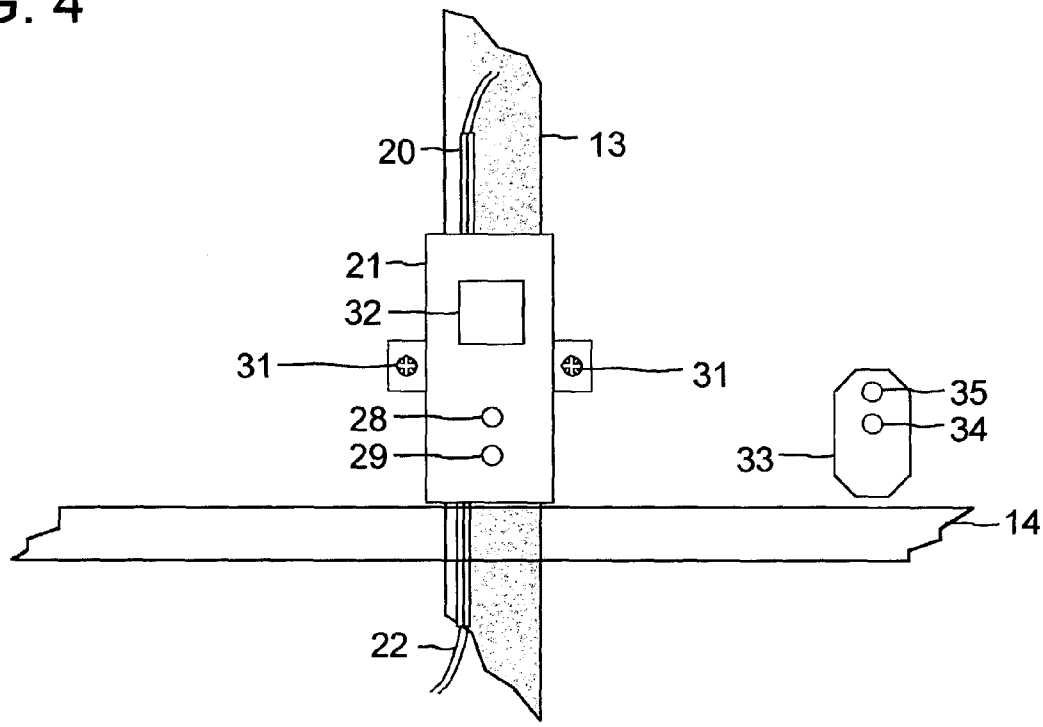
FIG. 4 illustrates a partial view of an embodiment of the present invention showing its control module mounted to the conventional patio umbrella mast adjacent to the top level of a table, with the mast installed through a hole in the table. Also illustrated are control module up and down-switches, electric wires, remote control receiver, and remote control transmitter.
Figure 5:
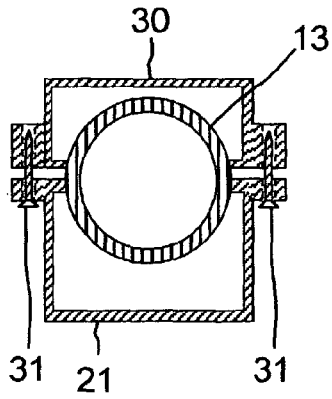
FIG. 5 illustrates a top down sectional view of a conventional patio umbrella mast and a partial embodiment of the present invention showing its control module and control module mounting bracket affixed to the mast.

One example of how to install the present invention is to position conventional patio umbrella 10 vertically with lower end of mast 13 supported in a freestanding position. Next, operate winch mechanism 12 to open canopy 11, or otherwise open canopy. Position motor housing 16 under canopy 11 near the uppermost end of mast 13 and hold against mast 13. As in FIG. 3, position motor housing mounting bracket 24 on the opposite side of motor housing 16 and hold both against mast 13. Join motor housing 16 and motor housing mounting bracket 24 using screws 25. When screws 25 are tightened motor housing 16 and motor housing mount bracket 24 are securely clamped to mast 13 and prevented from moving. As in FIG. 2, attach one end of cable 18 to cable reel 17 using retention means in the cable reel 17. Attach the opposite end of cable 18 to yoke 19 by inserting cable 18 through hole 39 in yoke 19 and secure by tying knot 42 at the end of cable 18 on the bottom side of yoke 19, or use an alternate means to affix cable 18 to yoke 19. Thereby yoke 19 is drivingly engaged with motor 26 by means of gears 27, cable reel 17 and cable 18. As in FIG. 4, position control module 21 against mast 13 on top of table 14. As in FIG. 5, position control module mounting bracket 30 on opposite side of mast 13 and control module 21. Join control module 21 and control module mounting bracket 30 using screws 31 as illustrated in FIG. 4 and FIG. 5. When screws 31 are tightened control module 21 and control module mounting bracket 30 are securely clamped to mast 13 and prevented from moving. Lower canopy 11 using winch mechanism 12 in FIG. 1 or use other means until canopy 11 closes fully. Inspect cable 18 to verify that it is stretched tight between cable reel 17 and yoke 19, and if necessary adjust length of cable 18 by relocating knot 42 until cable 18 is stretched tight between cable reel 17 and yoke 19. Winch mechanism 12, rope 40 and pulley 41 are now bypassed and no longer required, yet can remain in place and will not impede operation of the present invention. Plug AC-DC Adapter 23 into wall outlet.

Figure 2:
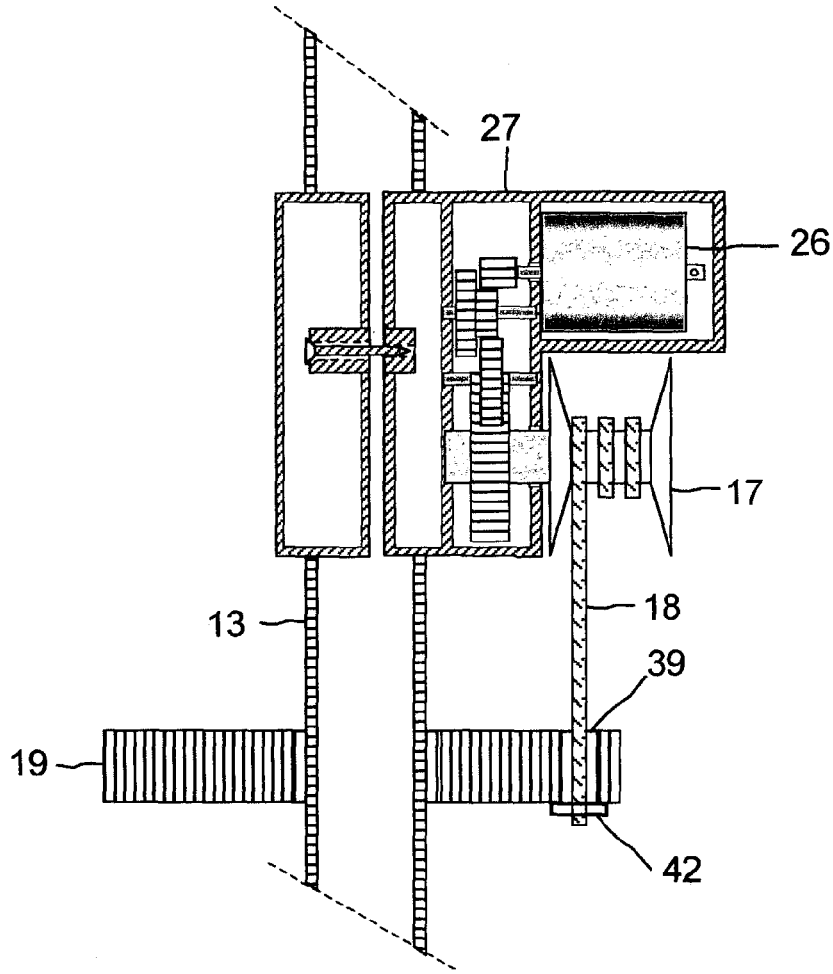
FIG. 2 illustrates a sectional partial embodiment of the present invention showing its motor housing and mounting bracket assembled to the mast of a conventional patio umbrella. The motor housing comprises a low voltage reversible motor driving gears and a cable reel. Also illustrated is a cable affixed to the cable reel and to the umbrella yoke.

In FIG. 4, control module 21 comprises up-switch 28 and down-switch 29 that respectively control first polarity and second polarity DC voltage to motor 26 in FIG. 2, and whereby actuating up-switch 28 couples the first polarity DC voltage from AC-DC Adapter 23 to drive motor 26 in clockwise rotation, and whereby actuating down-switch 29 couples the second polarity DC voltage from AC-DC Adapter 23 to drive motor 26 in counter-clockwise rotation. Also in FIG. 4, control module 21 comprises receiver 32 that is responsive to up-switch 35 and down-switch 34 of transmitter 33. Receiver 32 has means to control the first polarity and the second polarity DC voltage to motor 26, whereby actuating up-switch 35 causes receiver 32 to couple the first polarity DC voltage from AC-DC Adapter 23 to drive motor 26 in clockwise rotation, and whereby actuating down-switch 34 causes receiver 32 to couple the second polarity DC voltage from AC-DC Adapter 23 to drive motor 26 in counter-clockwise rotation.

To open canopy 11 using the present invention, press and hold up-switch 28 or up-switch 35 in FIG. 4 to thereby couple the first polarity DC voltage from AC-DC Adapter 23 through power cord 22 to the means of control module 21 and thereby to wire pair 20 and to motor 26. This causes motor 26 to be energized and rotate clockwise driving plurality of gears 27 and thereby cable reel 17. Cable reel 17 rotates and collects cable 18 thereby progressively raising yoke 19 on mast 13 and driving levers 37 against ribs 36 thereby causing ribs 36 to pivot upward on their mast attachment points and gradually force canopy 11 to an open position. When canopy 11 reaches desired open position, release up-switch 28 or up-switch 35 to thereby uncouple DC voltage to motor 26 causing motor 26 to stop. When motor 26 stops there is sufficient frictional engagement between motor 26 and gears 27 to prevent cable reel 17 from rotating, thereby cable 18 retains yoke 19 and canopy 11 in its present open position. To close canopy 11 using the present invention, press and hold down-switch 29 or down-switch 34 to thereby couple the second polarity DC voltage from AC-DC Adapter 23 through power cord 22 to the means of control module 21 and thereby to motor 26. This causes motor 26 to be energized and rotate counter-clockwise driving plurality of gears 27 and thereby cable reel 17.

Cable reel 17 rotates and dispenses cable 18 thereby reducing the holding force on yoke 19, whereby gravity causes yoke 19 to progressively move to a lower position on mast 13 and thereby levers 37 and ribs 36 follow and canopy 11 gradually closes. When canopy 11 reaches desired position, release down-switch 29 or down-switch 34 to thereby uncouple DC voltage to motor 26 causing motor 26 to stop. When motor 26 stops there is sufficient frictional engagement between motor 26 and gears 27 to prevent cable reel 17 from rotating, thereby cable 18 retains yoke 19 and canopy 11 in its present position.

Control module 21 can comprise additional means to start motor 26 and subsequently stop motor 26 automatically when canopy 11 attains open and closed travel limits. In this respect, to open canopy 11 by the additional means of control module 21, press and release up-switch 28 or up-switch 35 to thereby couple the first polarity DC voltage from AC-DC Adapter 23 through power cord 22 to the additional means of control module 21, wire pair 20, and thereby to motor 26. This causes motor 26 to be energized and rotate clockwise driving plurality of gears 27 and thereby cable reel 17. Cable reel 17 rotates and collects cable 18 thereby progressively raising yoke 19 on mast 13. Yoke 19 drives levers 37 against ribs 36 thereby causing ribs 36 to pivot upward on their mast attachment points and gradually force canopy 11 to an open position. When canopy 11 reaches its open travel limit the additional means of control module 21 automatically uncouples DC voltage to motor 26 causing motor 26 to stop. When motor 26 stops there is sufficient frictional engagement between motor 26 and gears 27 to prevent cable reel 17 from rotating, thereby cable 18 retains yoke 19 and thereby canopy 11 in its present position. Also in this respect, to close canopy 11 by the additional means of control module 21, press and release down-switch 29 or down-switch 34 to thereby couple the second polarity DC voltage from AC-DC Adapter 23 through power cord 22 to the additional means of control module 21, wire pair 20 and thereby to motor 26. This causes motor 26 to be energized and rotate counter-clockwise driving plurality of gears 27 and thereby cable reel 17. Cable reel 17 rotates and dispenses cable 18 thereby reducing the holding force on yoke 19, whereby gravity causes yoke 19 to progressively move to a lower position on mast 13 and thereby levers 37 and ribs 36 follow and canopy 11 gradually closes. When canopy 11 reaches its closed travel limit the additional means of control module 21 automatically uncouples DC voltage to motor 26 causing motor 26 to stop. When motor 26 stops there is sufficient frictional engagement between motor 26 and gears 27 to prevent cable reel 17 from rotating, thereby cable 18 retains yoke 19 and thereby canopy 11 in its present position.

I claim:

1. An electric device configured to open and close a patio umbrella canopy, the device being adapted to be removed from one patio umbrella and detachably attached to another patio umbrella, the patio umbrella comprising a canopy opening and closing means, the device being adapted as a means to drive the canopy opening and closing means, the device comprising: a reversible electric motor and gear means driving a cable reel affixed in a motor housing; the motor housing having means to detachably attach to the patio umbrella; a length of cable having means to detachably attach one end to the cable reel and means to detachably attach the opposite end to the canopy opening and closing means; a means to provide electricity; a control housing located separately and attachable at a different location from the motor housing, the control housing having means to detachably attach to the patio umbrella; the control housing comprising a motor controller having means to receive the electricity; the motor controller comprising electric cable means to the motor and a manual switch means and a remote controllable switch means to selectably connect and disconnect the electricity to the motor for controlling motor start and stop and direction of rotation for driving the cable reel to collect and dispense the cable for driving the canopy opening and closing means and causing the canopy to open and close and stop; a transmitter having means to control the remote controllable switch and remotely activate the device to selectably open and close and stop the canopy.

* * * * *